US010892542B2

(12) United States Patent
Sorrentino et al.

(10) Patent No.: US 10,892,542 B2
(45) Date of Patent: Jan. 12, 2021

(54) ANTENNA POSITIONING SYSTEM WITH AUTOMATED SKEWED POSITIONING

(71) Applicant: Windmill International, Inc., Nashua, NH (US)

(72) Inventors: Anthony Sorrentino, Fitchburg, MA (US); Mark Wheeler, Devens, MA (US); Matthew Richards, Hollis, NH (US); Keith Ayotte, Hudson, NH (US)

(73) Assignee: AQYR TECHNOLOGIES, INC., Nashua, NH (US)

( * ) Notice: Subject to any disclaimer, the term of this patent is extended or adjusted under 35 U.S.C. 154(b) by 1745 days.

(21) Appl. No.: 14/447,015

(22) Filed: Jul. 30, 2014

(65) Prior Publication Data

US 2018/0254554 A1 Sep. 6, 2018

Related U.S. Application Data

(60) Provisional application No. 61/861,522, filed on Aug. 2, 2013, provisional application No. 61/861,550, filed on Aug. 2, 2013.

(51) Int. Cl.
*H01Q 1/12* (2006.01)
*H01Q 3/08* (2006.01)

(52) U.S. Cl.
CPC ..... *H01Q 1/1257* (2013.01); *H01Q 1/1264* (2013.01); *H01Q 3/08* (2013.01)

(58) Field of Classification Search
CPC ..... H01Q 1/1257; H01Q 1/1264; H01Q 3/08
See application file for complete search history.

(56) References Cited

U.S. PATENT DOCUMENTS 5,061,945 A * 10/1991 Hull ..... H01Q 1/1235 343/840
5,214,364 A 5/1993 Perdue et al.
5,337,062 A 8/1994 Sherwood et al.
5,418,542 A 5/1995 Sherwood et al.
5,574,461 A 11/1996 Withag et al.
5,619,215 A 4/1997 Sydor
(Continued)

FOREIGN PATENT DOCUMENTS

KR 20020000277 A 1/2002
KR 101176920 B1 8/2012
(Continued)

OTHER PUBLICATIONS

Basari et al., "Development of Electronically Controlled Array Antenna System for ETS-VIII Applications", Proceedings of iWAT2008, Chiba, Japan, IEEE 2008, pp. 414-417.
(Continued)

*Primary Examiner* — Erin F Heard
*Assistant Examiner* — Donald H B Braswell

(57) ABSTRACT

A portable antenna system including a reflector with a center axis, a feed at the center axis of the reflector, a post with a rotatable bracket on the post. The system also includes a skew drive mounted to the bracket and having a first output coupled to the reflector at the center axis thereof to adjust the skew angle of the reflector, an elevation motor configured to rotate the rotatable bracket to vary the elevation of the reflector, and an azimuth motor configured to rotate the post to vary the azimuth of the reflector.

16 Claims, 18 Drawing Sheets

(56) References Cited

U.S. PATENT DOCUMENTS

| | | | | |
|---|---|---|---|---|
| 5,784,029 | A | 7/1998 | Geier | |
| 5,841,397 | A | 11/1998 | Hopkins | |
| 6,016,120 | A | 1/2000 | McNabb et al. | |
| 6,049,306 | A | 4/2000 | Amarillas | |
| 6,850,202 | B2 | 2/2005 | Watson | |
| 6,906,673 | B1 | 6/2005 | Matz et al. | |
| 6,937,199 | B2 | 8/2005 | King | |
| 7,218,273 | B1 | 5/2007 | Webster, Jr. et al. | |
| 7,528,773 | B2 | 5/2009 | Fall et al. | |
| 7,679,573 | B2 | 3/2010 | Shuster et al. | |
| 7,737,900 | B1 * | 6/2010 | Saindon | H01Q 1/125 343/760 |
| 7,839,348 | B2 | 11/2010 | Baker | |
| 8,284,112 | B2 | 10/2012 | Otto et al. | |
| 8,314,735 | B2 | 11/2012 | Park | |
| 2001/0046258 | A1 | 11/2001 | Wise et al. | |
| 2002/0084948 | A1 | 7/2002 | Watson | |
| 2007/0040687 | A1 | 2/2007 | Reynolds | |
| 2008/0258971 | A1 | 10/2008 | Nichols et al. | |
| 2009/0295654 | A1 * | 12/2009 | Baker | H01Q 1/125 343/713 |
| 2011/0215985 | A1 | 9/2011 | Kaplan et al. | |
| 2011/0298672 | A1 | 12/2011 | Otto et al. | |
| 2013/0307721 | A1 * | 11/2013 | Son | H01Q 3/08 342/352 |
| 2013/0321204 | A1 * | 12/2013 | Zahavi | H01Q 3/08 342/368 |

FOREIGN PATENT DOCUMENTS

| | | | |
|---|---|---|---|
| WO | WO 2000/010224 | A1 | 2/2000 |
| WO | WO 2006/116695 | A2 | 11/2006 |

OTHER PUBLICATIONS

Aloi et al., "A Relative Technique for Characterization of PCV Error of Large Aperture Antennas Using GPS Data", IEEE Transactions on Instrumentation and Measurement, vol. 54, No. 5, Oct. 2005, pp. 1820-1832.

* cited by examiner

ANTENNA POSITIONING SYSTEM WITH AUTOMATED SKEWED POSITIONING

RELATED APPLICATIONS

This application claims benefit of and priority to U.S. Provisional Application Ser. Nos. 61/861,522 and 61/861,550 both filed Aug. 2, 2013 under 35 U.S.C. §§ 119, 120, 363, 365, and 37 C.F.R. § 1.55 and § 1.78 and are incorporated herein by this reference.

FIELD OF THE INVENTION

This invention relates to an antenna system.

BACKGROUND OF THE INVENTION

Antenna positioning systems typically point an antenna towards a satellite in geosynchronous orbit above the earth to acquire the signals emitted from the transponder of the satellite. Antenna positioning systems typically include, inter alia, a dish or reflector and a feed or feed horn. The reflector receives the signals broadcast from the satellite transponder and focuses them on a focal point where the feed is located.

Some antenna reflectors focus the signals on a focal point located at the center axis of the reflector. Other antenna reflectors focus the signals on a focal point which is offset from the center axis of the reflector. The purpose of the offset design is to move the antenna feed out of the path of the incoming signal from the satellite to reduce the shadowing found in satellite systems with center axis feeds.

Some satellites may transmit signals in a circular band or in a linear polarization plane. In order to acquire signals transmitted in the linear polarization plane, the skew angle, or skew offset, of the reflector must be adjusted.

Some conventional antenna positioning systems with a centrally located focal point and feed rely on manually rotating the antenna to adjust the skew angle. Conventional antenna positioning systems with an offset focal point and offset feed similarly rotate the reflector and feed about the offset axis to adjust the skew angle. Such offset positioning systems may include features to automatically adjust the skew angle. However, the offset antenna positioning systems may require various components associated with transmitting and receiving signals to be located in or on the offset feed. The offset feed also requires a longer RF path which will induce losses. The offset design also results in a larger moment arm and therefore requires a larger and more powerful drive motor to rotate the antenna reflector.

Commercial and military satellites have both beacon and transponder broadcasts. Each satellite typically has multiple transponders that are used for data transfer. These transponders often have overlapping areas of reception on the surface of the earth. Users of satellite antenna systems need to orient the receiving antenna dish to the correct azimuth and elevation to receive an optimal signal from the desired satellite. For satellite signals broadcast in a linear polarization plane, the correct skew angle must also be set. Users need to differentiate between the desired signal from all other signals that can be received at a single location.

Conventional satellite antenna systems, for acquiring broadcast transponder signals from a satellite, may use the GPS location of the satellite antenna, the coordinates of the satellite, and a compass to orient the receiver dish to the correct azimuth. An inclinometer may be used to orient the reflector or dish to the correct elevation, and a skew adjustment is done manually or automatically by inputting the values from a preset table of values for a particular satellite and transponder. Such steps may have inherent errors due to the mechanical placement of the various components.

After the antenna dish is pointed to the desired satellite, conventional systems rely on a terminal and software to identify the received signals. Using the manually input information, the user identifies multiple signals, each of varying strength, which the terminal is receiving. Software may then be used to identify which of the broadcasted transponder signals the antenna positioning system is receiving and the result may be displayed on a terminal. If the signal strength is inadequate, the user must manually adjust the antenna orientation to maximize the signal. This alignment can be performed either by mechanical adjustments or motorized adjustments via a terminal application. The antenna is moved again until the data appears to be consistently streamed via the software application. However, such a technique requires significant user analysis and intervention. The manual acquisition of the satellite signal is also cumbersome, time consuming and inefficient. The existing process also relies on a single, fixed satellite configuration, however satellite configurations may change.

Conventional antenna positioning systems also typically include a modem to form a signal lock after the operator has positioned the antenna to maximize the energy per bit of signal. However, using a modem may require additional components, complexity, and expense to the antenna positioning system. Also, a modem provisioned for one satellite broadcast signal may not operate correctly for other satellite broadcast signals. Other conventional antenna positioning systems may rely on a reference satellite to calculate the position of the desired satellite. However, the configuration of the reference satellite may change resulting in the need to recalibrate the system.

SUMMARY OF THE INVENTION

Thus, there is a need for an antenna positioning system with centrally located feed and a need to automatically adjust the skew angle of the reflector to acquire satellite signals broadcast in a linear polarization plane. Featured is a transportable $K_U$ band antenna system with fully automated satellite signal acquisition.

In one aspect, a portable antenna system is featured. The system includes a reflector with a center axis, a feed at the center axis of the reflector, and a post with a rotatable bracket on the post. The system also includes a skew drive mounted to the bracket and having a first output coupled to the reflector at the center axis thereof to adjust the skew angle of the reflector, an elevation motor configured to rotate the rotatable bracket to vary the elevation of the reflector, and an azimuth motor configured to rotate the post to vary the azimuth of the reflector.

In one example, the antenna system may include a transceiver coupled to the skew drive. The skew drive may include a second output coupled to the transceiver. The skew drive may be configured to rotate the first output at the same rate as the second output. The post may include a distal housing and the rotatable bracket may be rotatably attached to the distal housing. The elevation motor may be fixed inside the housing and may include an output drive coupled to the rotatable bracket. The antenna system may include a base unit supporting the post. The base unit may include an azimuth motor configured to rotate the post with respect to the base unit. The base unit may include a computer subsystem configured to control the skew drive, the elevation motor, and the azimuth motor. The antenna system may include a tripod supporting the base unit. The reflector may include a plurality of petals releasably coupled together.

In another aspect, a portable antenna system is featured. The system includes a reflector, a skew drive coupled to the reflector to adjust the skew angle of the reflector, and a transceiver coupled to the skew drive for rotation with the reflector.

In one example, the reflector may have a center axis, there may be a feed at the center axis of the reflector, and the skew drive may rotate the reflector about said center axis. The system may include a post with a rotatable bracket and the skew drive may be mounted to the rotatable bracket. The system may include an elevation motor configured to rotate the rotatable bracket to vary the elevation of the reflector. The system may include an azimuth motor configured to rotate the post to vary the azimuth of the reflector. The system may include a base unit supporting the post. The system may include a tripod supporting the base unit. The reflector may include a plurality of petals releasably coupled together.

In yet another aspect, a portable antenna system is featured. The system includes a base unit, a post upstanding from and rotatable with respect to the base unit, a bracket rotatable with respect to the post, a skew drive mounted to the bracket, and a reflector coupled to the skew drive for adjustment of the skew angle of the reflector.

In one example, the antenna system may include a feed at a center axis of the reflector. The skew drive may have a first output coupled to the reflector at the center axis thereof. The antenna system may include an elevation motor configured to rotate the rotatable bracket to vary the elevation of the reflector. The antenna system may include an azimuth motor configured to rotate the post to vary the azimuth of the reflector. The antenna system may include a transceiver coupled to the skew drive. The skew drive may include a second output coupled to the transceiver. The skew drive may be configured to rotate the first output at the same rate as the second output. The antenna system may include a tripod supporting the base unit. The reflector may include a plurality of petals releasably coupled together.

The subject invention, however, in other embodiments, need not achieve all these objectives and the claims hereof should not be limited to structures or methods capable of achieving these objectives.

BRIEF DESCRIPTION OF THE SEVERAL VIEWS OF THE DRAWINGS

Other objects, features, and advantages will occur to those skilled in the art from the following description of a preferred embodiment and the accompanying drawings, in which.

DETAILED DESCRIPTION OF THE INVENTION

Figure 1:
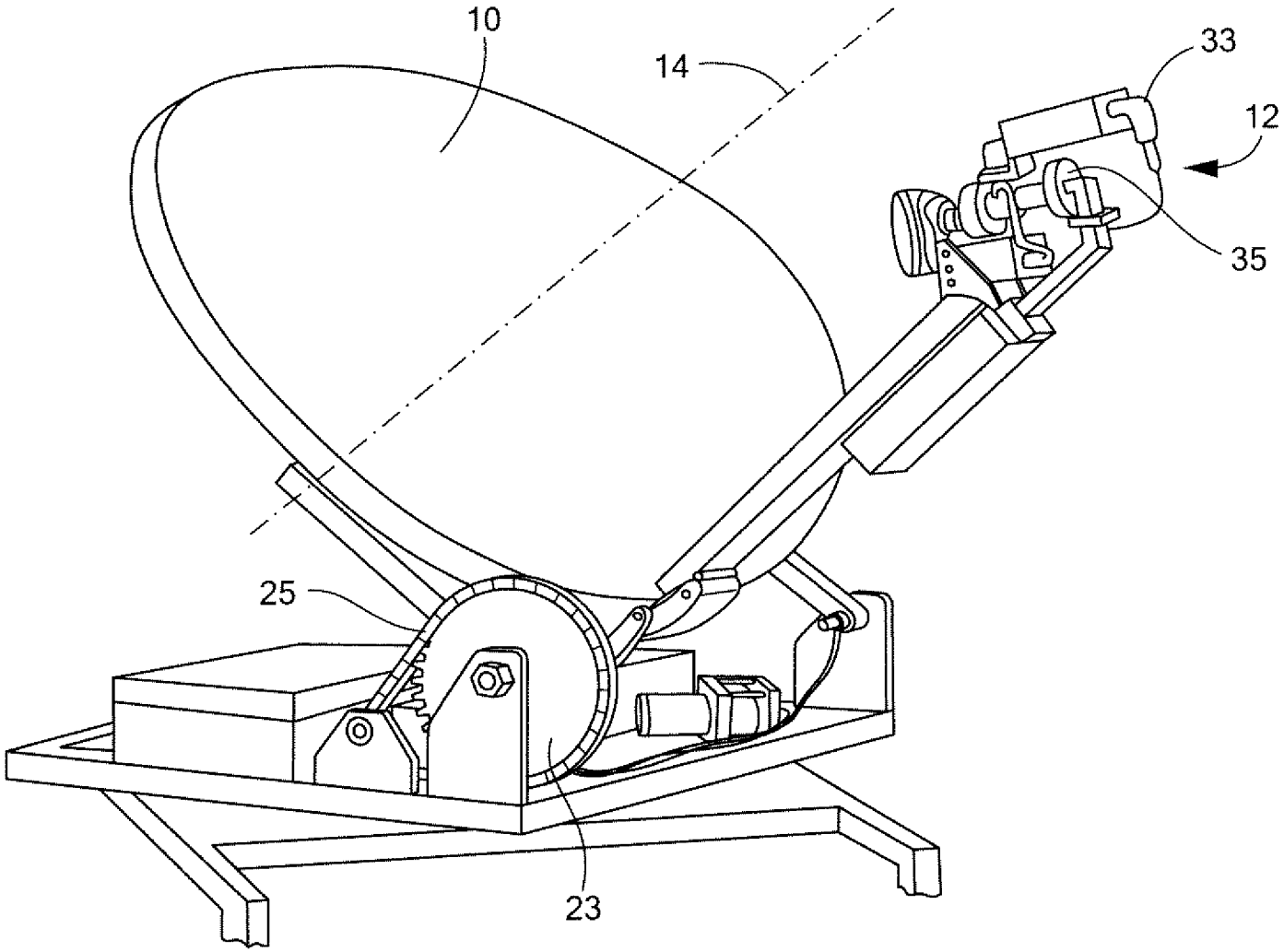
FIG. 1 PRIOR ART
FIG. 1 is a schematic view showing the front of a prior art antenna.

Aside from the preferred embodiment or embodiments disclosed below, this invention is capable of other embodiments and of being practiced or being carried out in various ways. Thus, it is to be understood that the invention is not limited in its application to the details of construction and the arrangements of components set forth in the following description or illustrated in the drawings. If only one embodiment is described herein, the claims hereof are not to be limited to that embodiment. Moreover, the claims hereof are not to be read restrictively unless there is clear and convincing evidence manifesting a certain exclusion, restriction, or disclaimer.

As discussed in the Background section above, conventional antenna positioning systems with a feed located at the center axis of the reflector usually rely on manually rotating the reflector to adjust the skew angle. Other conventional antenna positioning systems rely on rotating the reflector and feed horn about a focal point which is offset or off-axis from the center axis reflector to adjust the skew angle to acquire satellite signals broadcast in a linear polarization plane. For example, U.S. Pat. No. 7,839,348, incorporated by reference herein, includes parabolic reflector 10, FIGS. 1-2 and offset feed horn 12 which receives satellite signals broadcast in the $K_U$ band. The focal point of reflector 10 is offset from center axis 14 to direct the satellite signals to offset feed 12. In order the adjust the skew angle, the '348 patent teaches skew adjusting unit 20, FIG. 2, with skew sprocket 22 mounted to reflector 10 and skew servo motor 24 which drives skew sprocket 22 about axis 28, which is offset from center axis 14 to rotate parabolic reflector 10. Elevation adjustment is via sprocket 23, FIG. 1, and chain 25 about another sprocket driven by a motor.

U.S. Pat. No. 8,284,112, incorporated by reference herein, similarly discloses an antenna with offset feed and an offset focal point which is rotated about an offset axis point to adjust the skew of antenna system.

Figure 2:
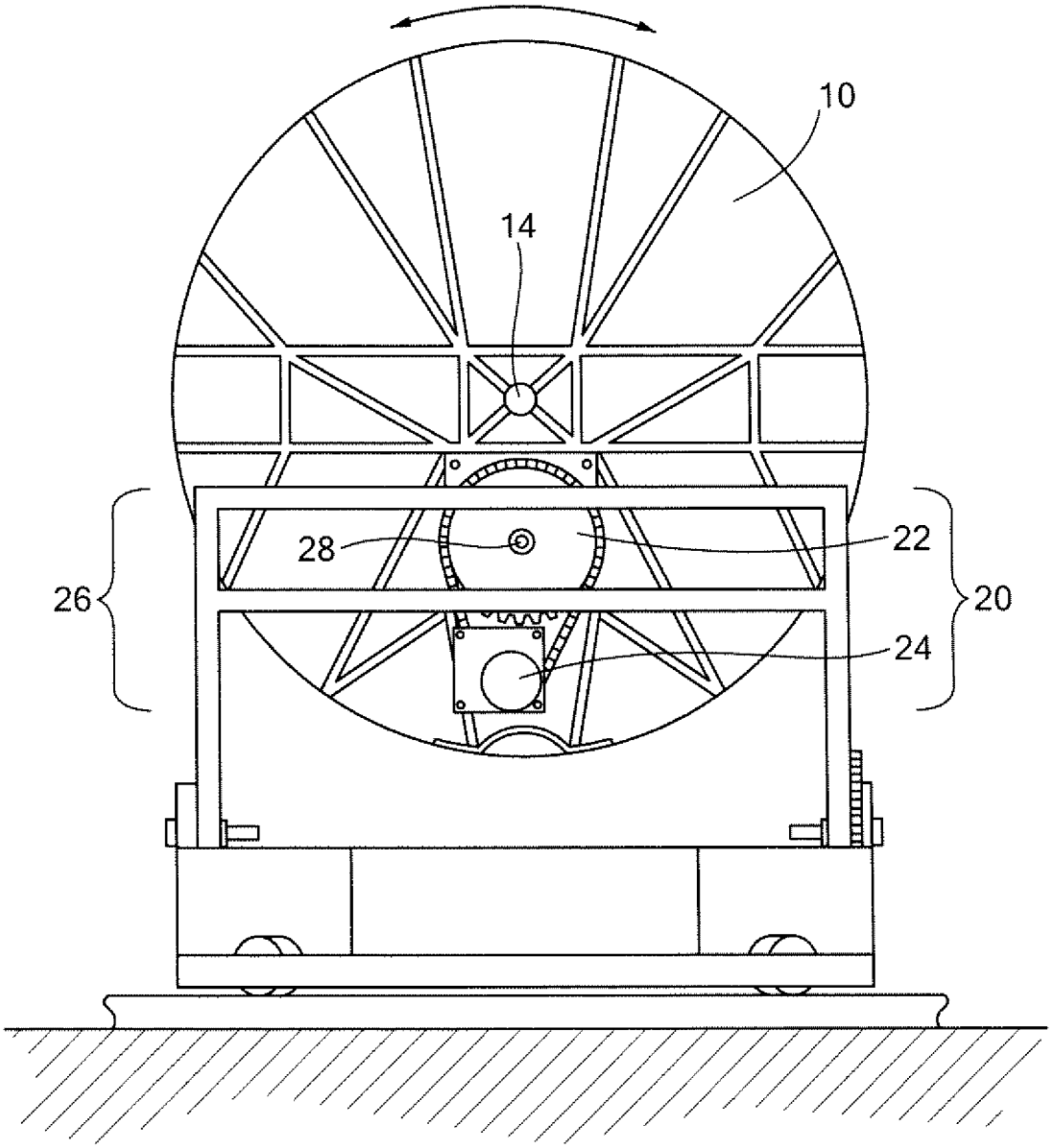
FIG. 2 PRIOR ART
FIG. 2 is a schematic view showing the rear of the antenna of FIG. 1.

As discussed in the Background section above, conventional antenna positioning systems such as the '348 patent and the '112 patent require various components associated with transmitting and receiving signals to be located on the offset feed, e.g., LNB 33, FIG. 1, orthomode transducer (OMT), and wave guide 35 located on offset feed 12. The offset focal point also has a large moment arm and therefore requires a larger and more powerful drive motor 24, FIG. 2.

Featured here is an antenna positioning system with automated skew positioning. One embodiment of this invention includes antenna subsystem 52, FIGS. 3-5 which includes reflector 54 and feed 56 located at center axis 58 of reflector 54. Feed 56 can be releasably affixed to plate 76. Antenna subsystem 52 is configured to receive signals from a satellite transponder broadcast in a linear polarization plane and to focus the signals on feed 56 located at center axis 58 of reflector 54. In one example, the antenna is configured as a 1.0 meter $K_U$ band system.

Figure 3:
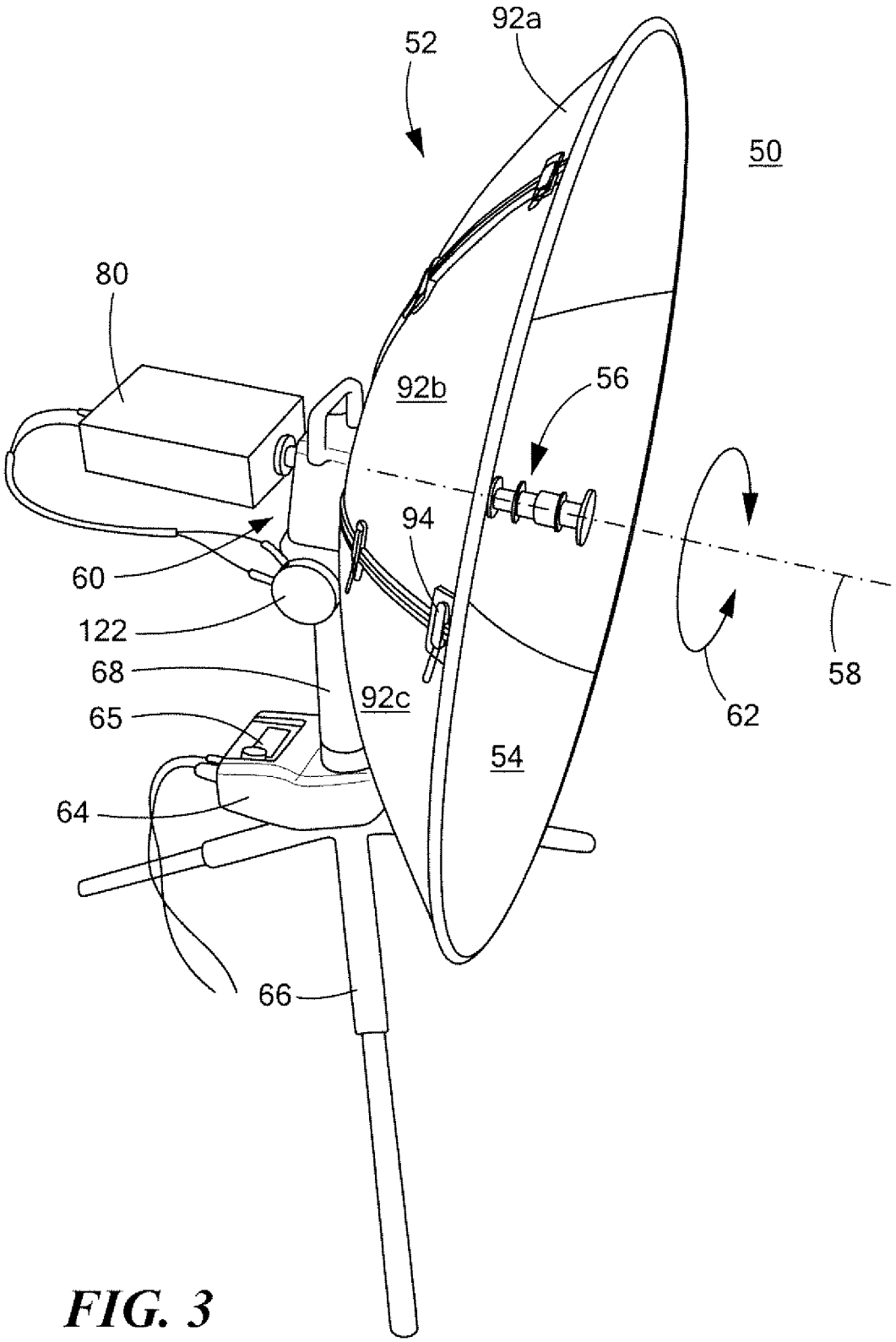
FIG. 3 is a schematic view showing the primary components associated with an example of a portable antenna in accordance with the invention.
Figure 4:
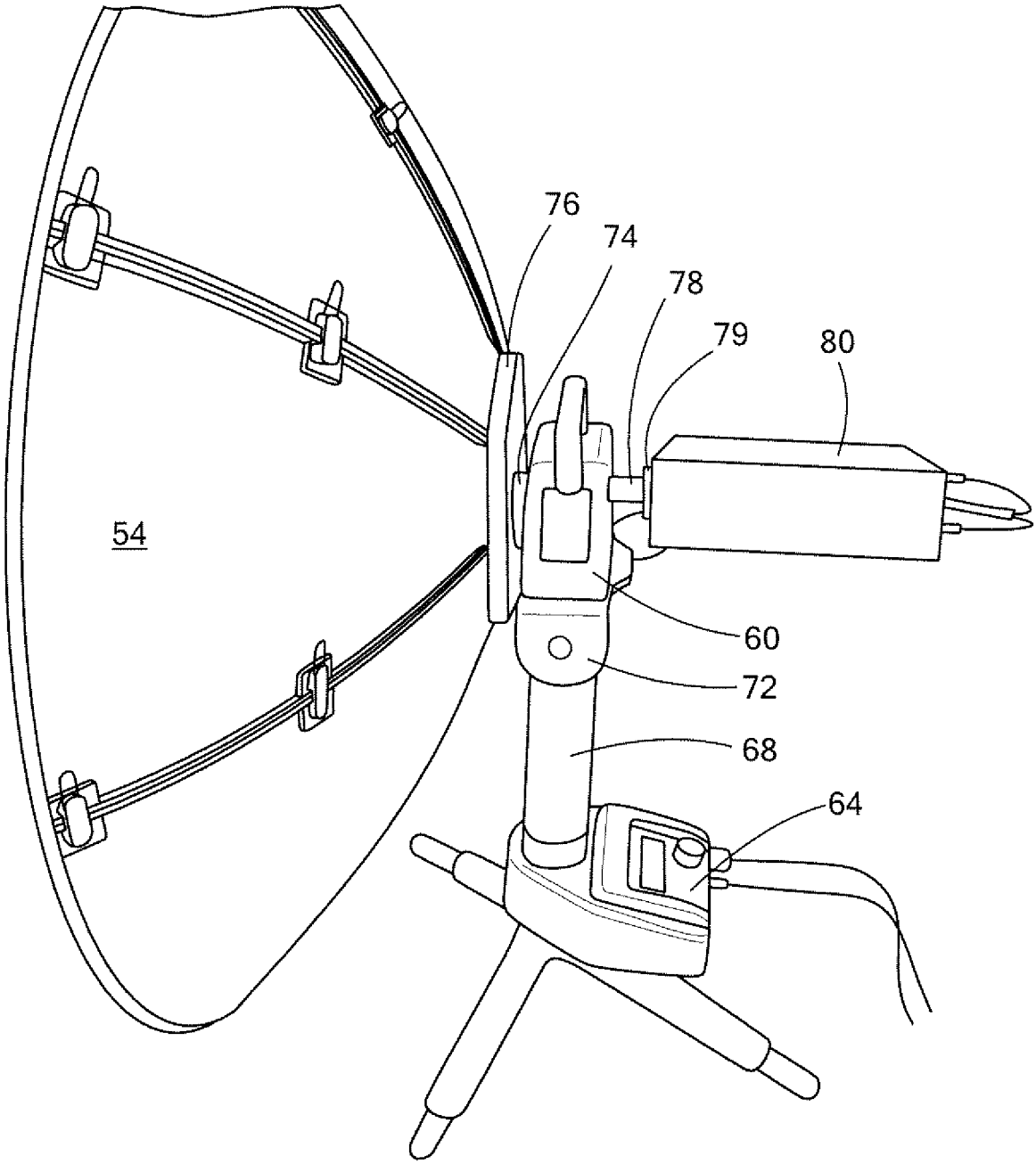
FIG. 4 is another schematic view of the antenna shown in FIG. 3.
Figure 5:
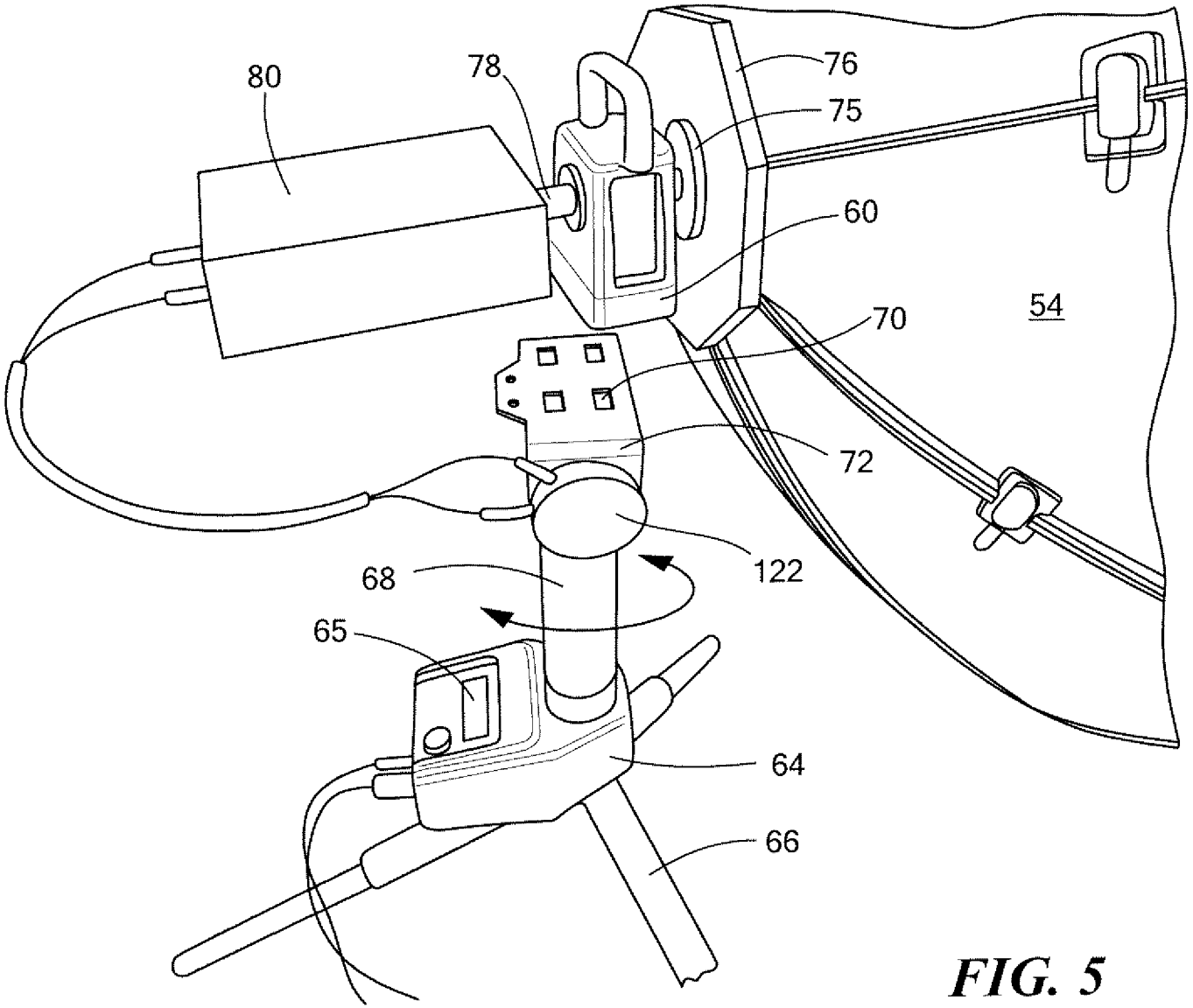
FIG. 5 is a schematic view showing how the antenna reflector, skew drive, and transceiver can be decoupled from and coupled to the antenna support subsystem.

In this particular example, the portable antenna system includes base unit 64, FIGS. 3-5 supported by tripod 66 with telescoping legs. Post 68 is rotatably coupled to base unit 64 and driven by an azimuth adjustment motor inside base unit 64. The distal end of post 68 supports a tube shaped housing 70 (FIG. 8) with bracket 72, FIG. 4 rotatably coupled thereto. Skew drive 60 is mounted to the top of bracket 72 in this example and includes forward output drive shaft 74 coupled to the center of the rear of reflector 54 via flange 75 and plate 76 fastened to the rear of reflector 54. Preferably, skew drive 60 also includes rearward output drive shaft 78 coupled to transceiver 80 via flange 79. When skew drive 60 is operated under the control of a computer subsystem preferably associated with base 64, shafts 74 and 78 rotate at the same rate and in the same direction to adjust the skew angle of reflector 54. In this particular example, a polarizer is built into transceiver 80 and so shaft 78 rotates transceiver 80 and its polarizer the same as reflector 54 is rotated to automatically acquire satellite transponder signals broadcast in a linear polarization plane. Skew angle algorithms for the computer subsystem are known in the art. The computer subsystem may feature or include a microcontroller, a processor, an application specific integrated circuit, and/or a field programmable gate array, or the like and associated signal conditioning circuitry for carrying out the instructions of the algorithms and controlling the skew, azimuth, and elevation motors.

In one preferred design, an elevation motor (e.g., a harmonic drive) is configured to rotate bracket 72 relative to post 68 to vary and adjust the elevation or inclination of reflector 54. Also, an azimuth motor is configured to rotate post 68 to vary and adjust the azimuth of reflector 54. The computer subsystem associated with base unit 64 controls the elevation motor and azimuth motor to adjust the elevation and azimuth of reflector 54 automatically. Known elevation and azimuth control algorithms can be used but preferably the algorithms described herein are used.

Figure 6:
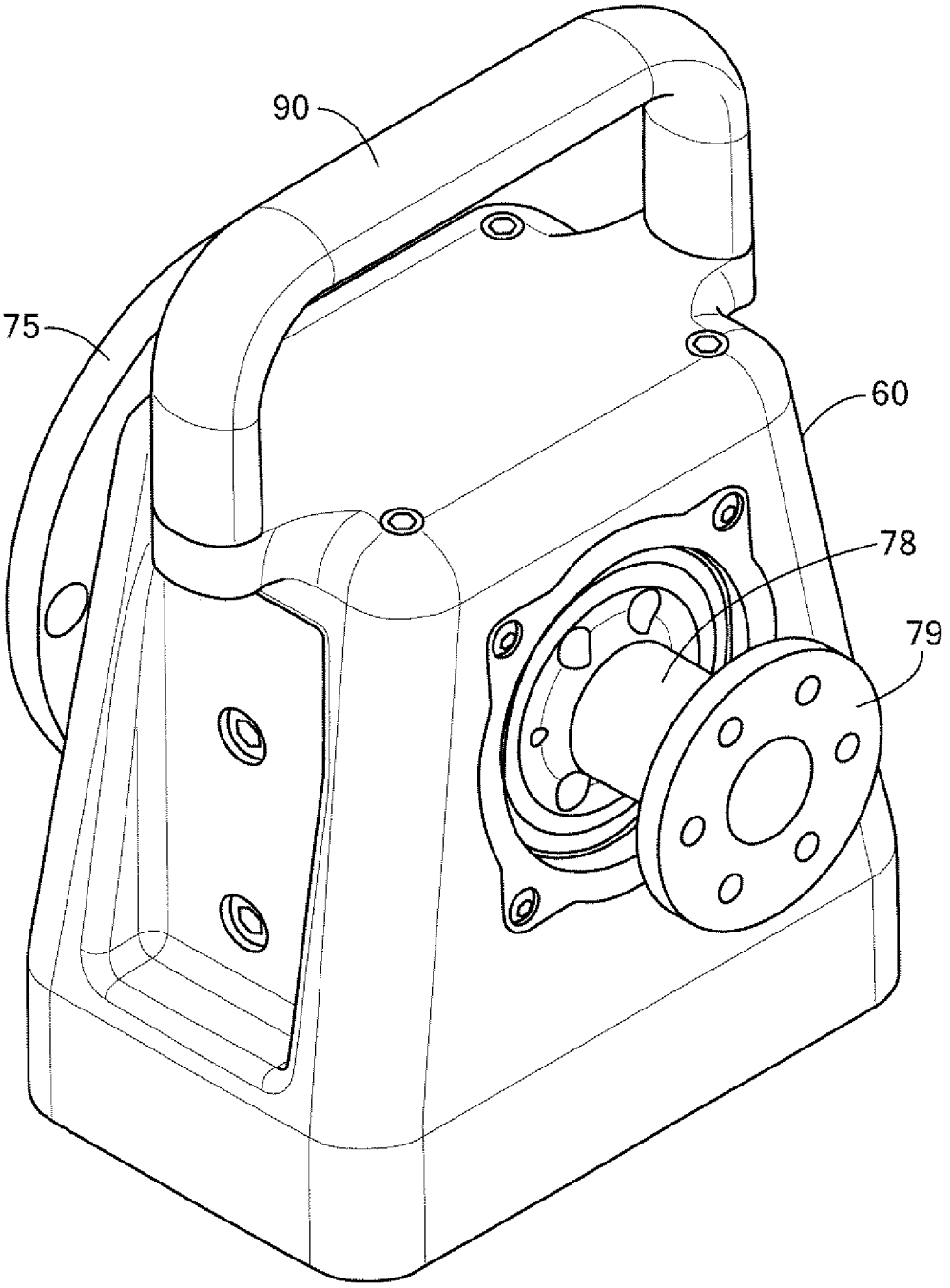
FIG. 6 is a schematic view showing the skew drive for the portable antenna.

Preferably skew drive 60, FIG. 6 includes handle 90 for easy handling of the skew drive during assembly and disassembly of the system in the field. The feed 56 can be decoupled. The individual reflector petals 92*a*, 92*b*, 92*c*, and the like (see FIG. 3) can be decoupled from each other for storage via clips such as the clips shown at 94. The skew drive 60 can be decoupled from bracket 72 and the reflector petals can be removed from plate 76. The legs of tripod 66 can be collapsed and tripod 66 can be decoupled from base unit 64 for compact transport of the antenna system components in a single shipping container or transit case.

Figure 7:
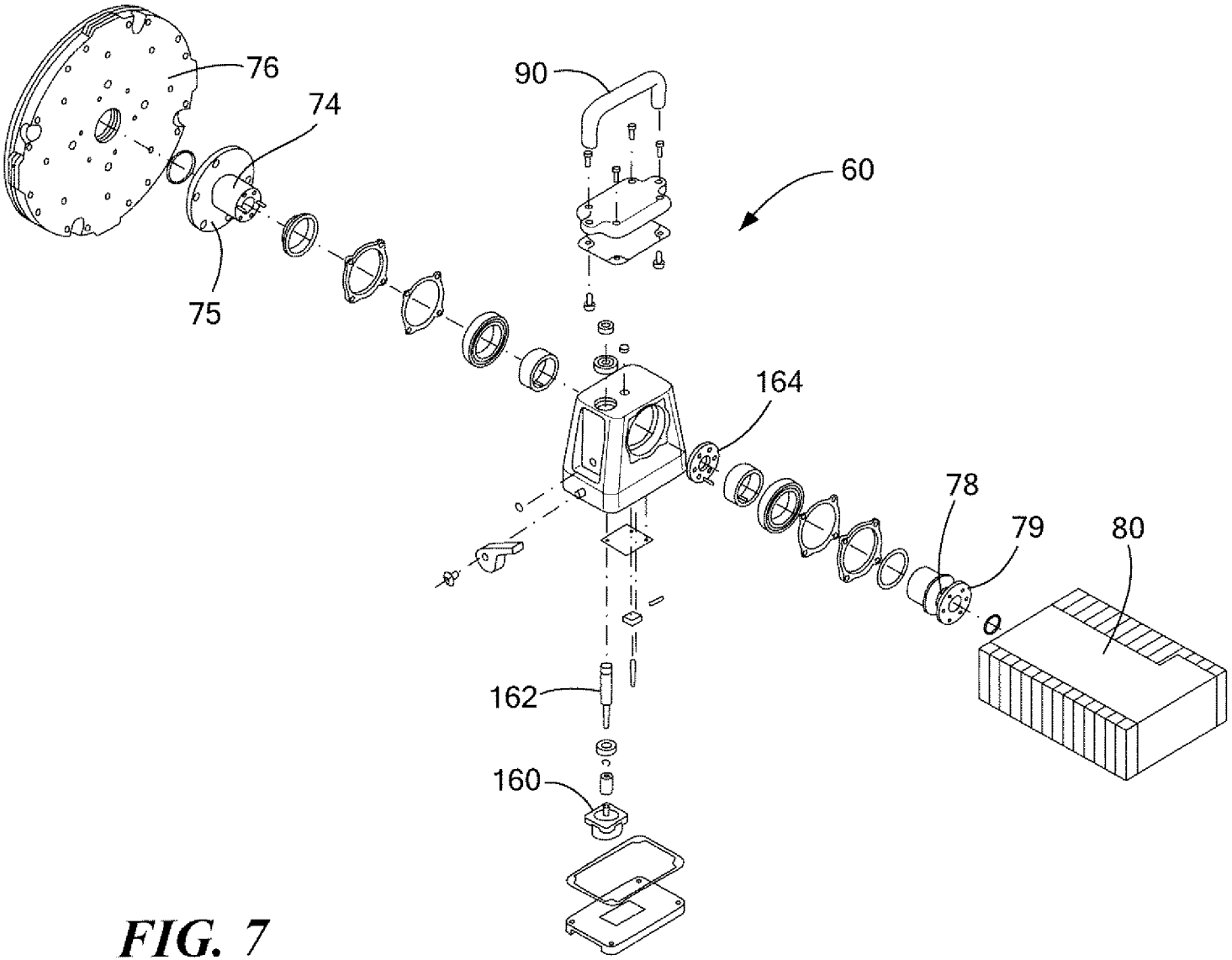
FIG. 7 is an exploded view showing the primary components associated with the antenna skew drive of FIG. 6.

As shown in FIG. 7, the skew drive includes skew motor 160 which rotates worm gear shaft 162 which drives gear 164. Gear 164 drives (rotates) both the forward and rearward outputs of the skew drive including shaft 74 (connected to flange 75) and shaft 78 (attached to flange 79). Thus, gear 164 is coupled to flanges 75 and 79 to simultaneously rotate the dish (coupled to flange 75 through plate 76) and transceiver 80 (coupled to flange 79).

Figure 8:
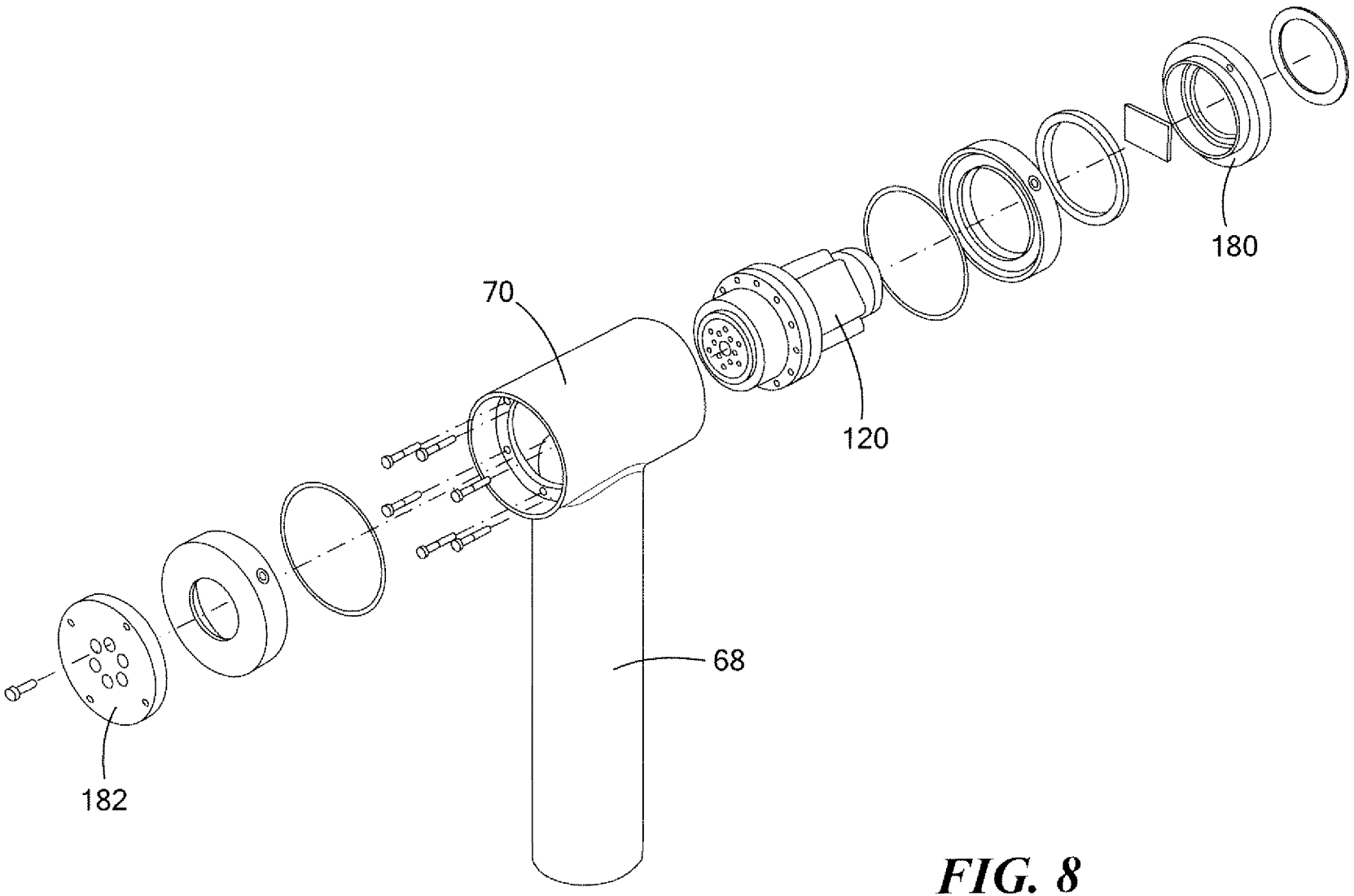
FIG. 8 is a schematic exploded view showing the primary components associated an example of an antenna elevation drive.

As shown in FIG. 8, elevation motor 120 is fixed inside post 68 distal housing 70. In FIG. 8, plate 182 is bolted to the rotating bracket (72, FIG. 5) and is driven by motor 120. In this way, elevation motor 120 rotates the bracket relative to housing 70 of post 68. Ring 180 rotates relative to housing 70 and is fixed to the other side of the bracket and to coupling 122, FIG. 3 which receives signals from transceiver 80 to be routed to the base unit.

Figure 9:
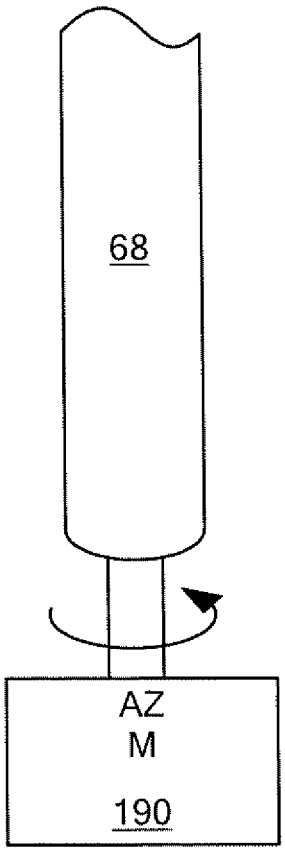
FIG. 9 is a schematic exploded view showing the primary components associated with the antenna azimuth drive.

For the azimuth drive, various designs can be used. FIG. 9 shows a simplified version where azimuth motor 190 rotates post 68 relative to base unit 64, FIG. 1.

Figure 10:
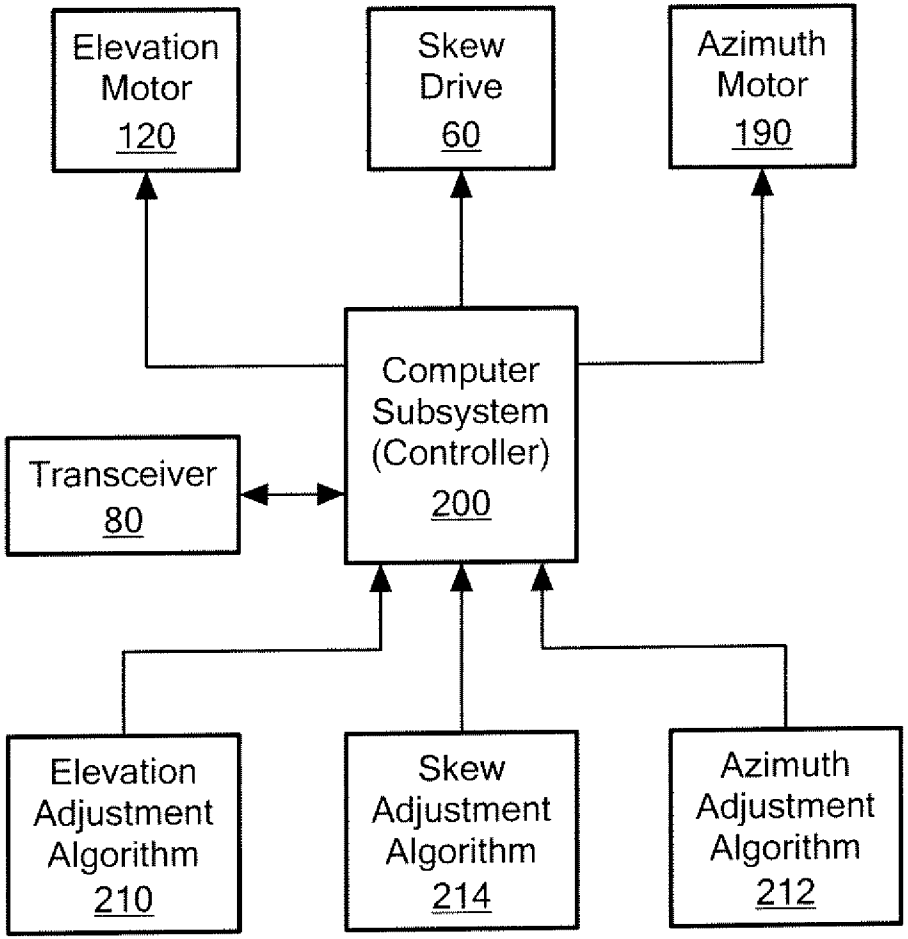
FIG. 10 is a block diagram showing the various subsystems used to adjust the skew angle, azimuth, and elevation of the reflector.

Computer subsystem 200, FIG. 10 (e.g., one or more microcontrollers, drivers, and/or microprocessors) is preferably located in base unit 64, FIG. 1 and is configured to determine the correct skew angle, azimuth, and elevation using algorithms 214, 212, and 210 to align the antenna reflector and to determine the best reflector and transceiver skew angle associated with satellite transponder signals broadcast in a linear polarization plane. Computer subsystem 200 then controls azimuth motor 190 and elevation motor 120 to point the reflector in the correct azimuth and elevation directions. Computer subsystem 200 may also automatically control skew drive 60 to rotate the reflector, the feed, and the transceiver an appropriate number of degrees, setting the skew angle of the reflector so as to accurately and efficiently acquire any linearly polarized signals.

In one example, the adjustment algorithms primarily rely on the RF strength of the signals broadcast from the transponder of a satellite to acquire the antenna. Once the user selects a desired satellite and inputs the required information, computer subsystem 200 calculates and programs transceiver 80 to the appropriate frequency. The adjustment algorithms then use the latitudinal and longitudinal position via GPS (not shown) to determine where the reflector should be aimed initially using azimuth motor 190 and elevation motor 120 in order to acquire the transponder signals broadcast by the satellite. Algorithm 214 automatically adjusts the skew angle of reflector to acquire the satellite transponder signals broadcast in a linear polarization plane.

Note that skew drive 60, FIGS. 3-4 rotates the antenna 52 about its center axis. Thus, the antenna has a centrally located feed and efficiently rotates the antenna about center axis 52 to automatically adjust the skew angle. Such a design reduces the moment arm required to rotate reflector 54, feed, and transceiver as compared to the offset or off-axis antenna positioning systems discussed above. This allows the drive system to use a less powerful and less expensive motor. The centrally located feed also eliminates the problems associated with an offset feed as discussed above.

In one specific preferred design, which can also be used to acquire satellite signals using other antenna system, the satellite signal processing/controller subsystem operates as follows.

Figure 11:
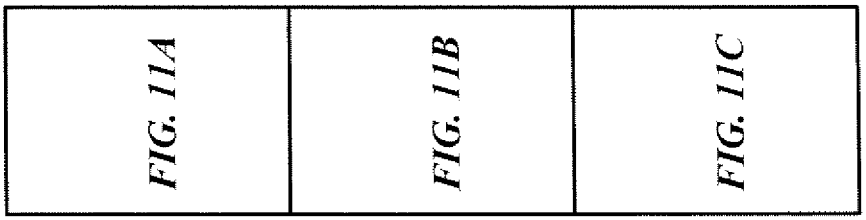
FIG. 11 is a block diagram depicting FIGS. 11A, 11B, and 11C.
Figure 11A:
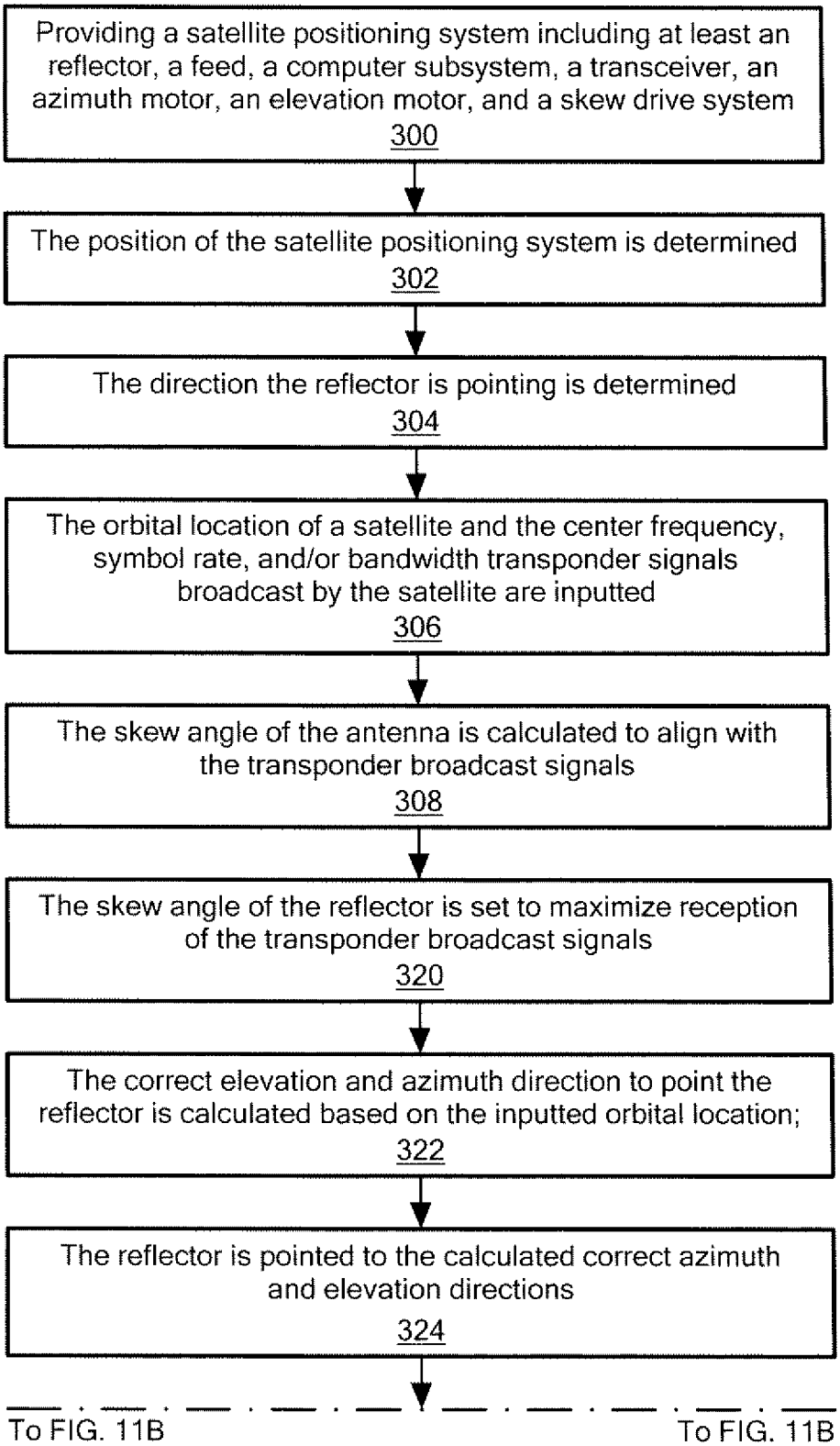
FIGS. 11A-11C are flow charts depicting the primary steps associated with methods of and systems for tracking a satellite signal in accordance with an example of the subject invention.
Figure 11B:
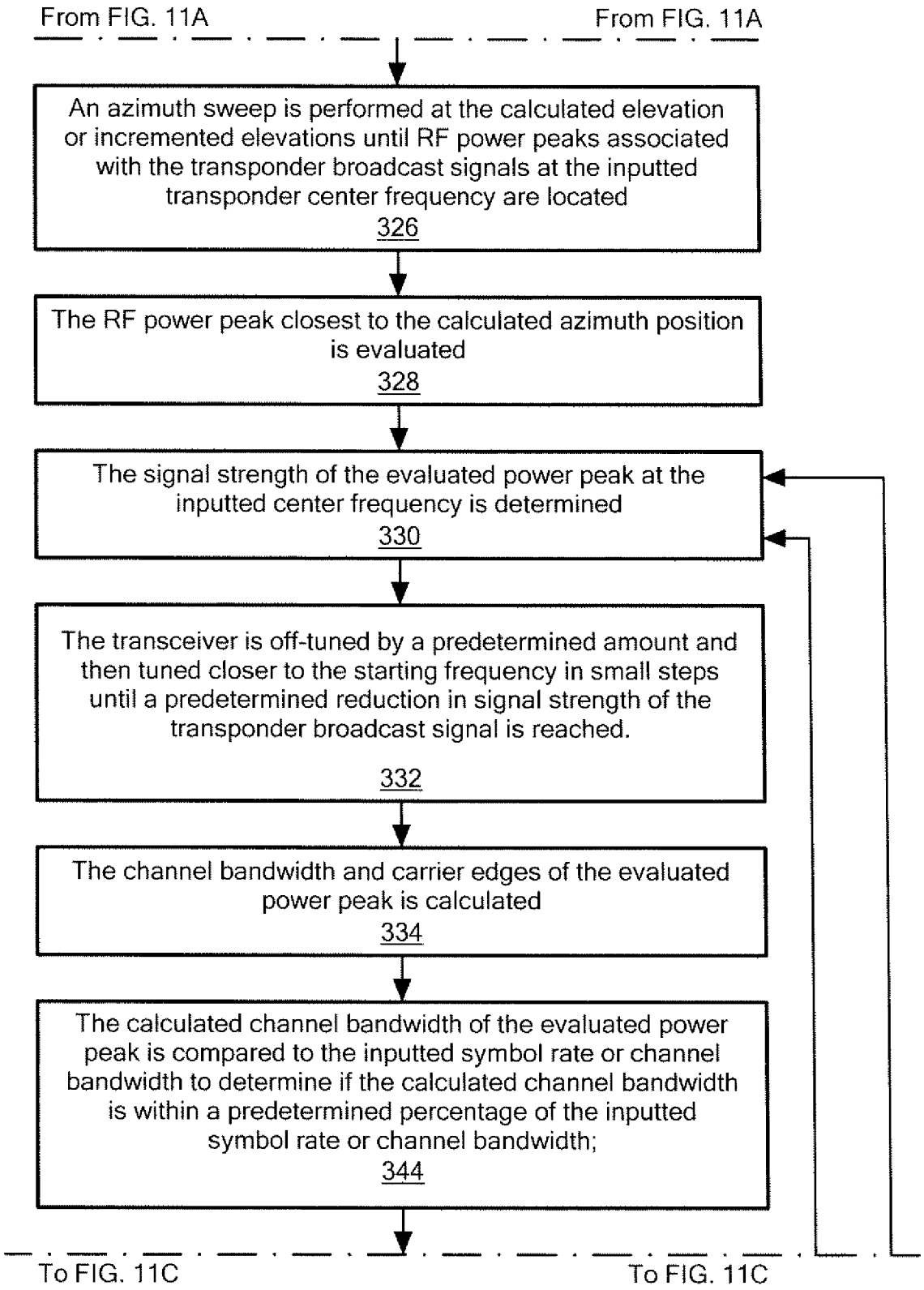
Figure 11C:
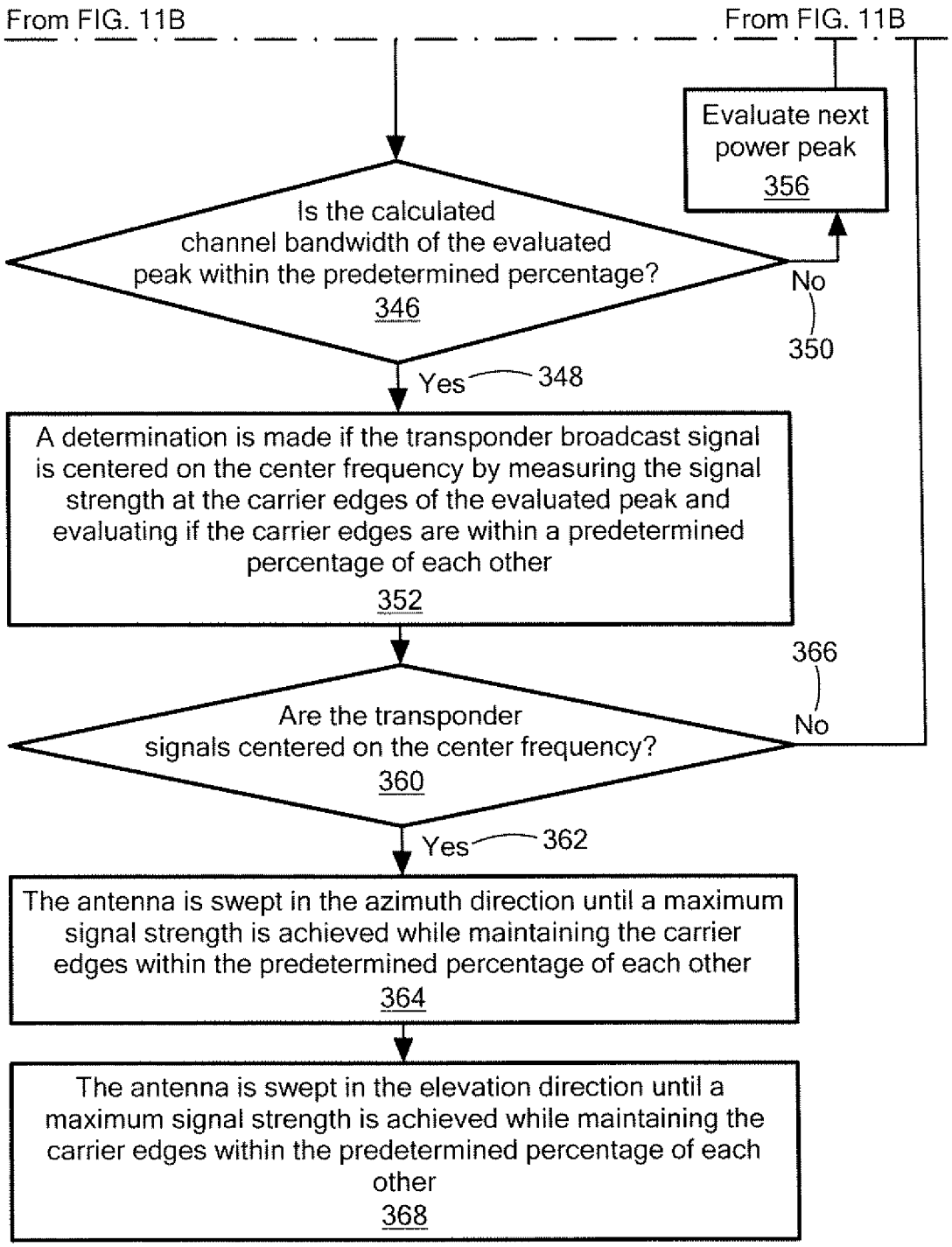

There is shown in FIGS. 11-11C one embodiment of the automated, modem-less method for tracking satellite transponder signals of this invention. The method includes providing an antenna system including at least a reflector and a feed, or other satellite antenna, e.g., flat panel slot array, box horn array, and the like, collectively referred to herein as an antenna, a computer subsystem, a transceiver, an elevation motor, an azimuth motor, and preferably a skew motor if needed, step 300. The method also includes determining the position of the satellite antenna system, step 302. The direction the satellite dish is pointing is then determined, step 304. The orbital location of the satellite and the center frequency, symbol rate and/or broadcast bandwidth of the transponder broadcast signal is then input, step 316. The skew angle of the transponder broadcast signal is then calculated, step 318. The skew angle of the antenna dish is then set to maximize reception of the transponder broadcast signals, step 320. The correct elevation and azimuth direction to point the antenna dish is then calculated based on the inputted orbital location of the satellite, step 322. The antenna dish is then automatically pointed to the calculated correct azimuth and elevation direction, step 324, using the azimuth and elevation drives. An azimuth sweep at the calculated elevation is then performed to locate RF power peaks associated with the transponder broadcast signals at the inputted center frequency, step 326. If no RF power peaks are located, step 326 is repeated until RF peaks associated with the transponder broadcast signals are located. The RF power peak closest to the calculated azimuth position is then evaluated, step 328. The signal strength of the evaluated power peak at the inputted center frequency is then determined, step 330, FIG. 11B. The transceiver is then off-tuned by a predetermined amount, e.g., about 40%, and then tuned closer to the starting frequency in small steps until a predetermined reduction in signal strength of the transponder broadcast signal is reached, e.g., about a 15% reduction in comparison to the signal strength of the evaluated power peak, Step 332. The channel bandwidth and carrier edges of the evaluated power peak are calculated, step 334, e.g., by subtracting the predetermined reduction in the signal strength from the signal strength of the evaluated power peak and multiplying that result by 2.

Figure 12:
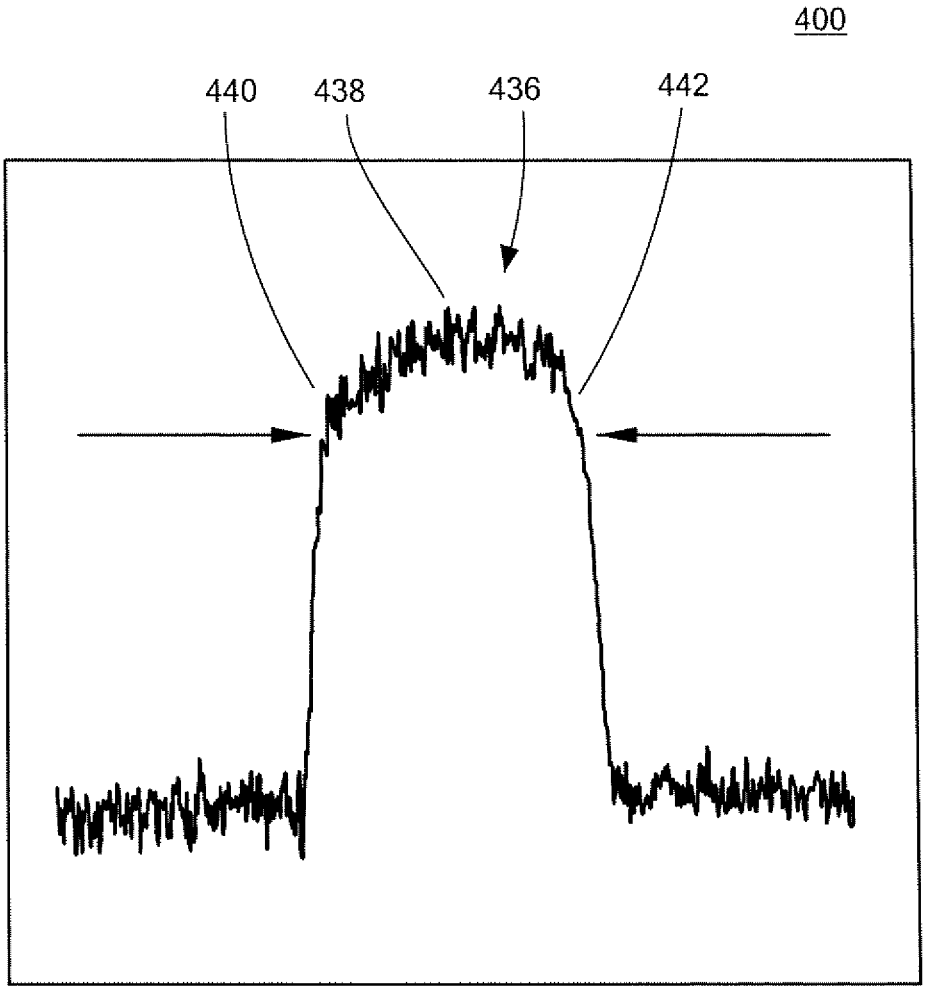
FIG. 12 is a view of one representation of a received satellite signal on the frequency domain.

FIG. 12 shows one example of evaluated power peak 436 with center frequency 438 and carrier edges 440 and 442. The calculated channel bandwidth of the evaluated power peak is compared to the inputted symbol rate or channel bandwidth to determine if the calculated channel bandwidth is within a predetermined percentage of the input symbol rate or channel bandwidth, step 344, FIG. 11B, e.g., more that about 80% but less than about 150% of the input symbol rate or channel bandwidth. A determination is made whether the channel bandwidth of the evaluated peak is within the predetermined percentage, step 346. If yes, indicated at step 348, a determination is made whether the transponder broadcast signal is centered on the center frequency by measuring the signal strength at the carrier edges of the evaluated peak and evaluating it to whether the carrier edges are within a predetermined percentage of each other, e.g., about 2%, step 352. If no, indicated at step 350, the next power peak is evaluated, step 356, and steps 330-346 are performed again. A determination is made if the transponder broadcast signals are centered on the center frequency, step 360. If yes, indicated at step 362, an antenna sweep in the azimuth direction is performed until maximum signal strength is achieved while maintaining the predetermined percentage between the carrier edges, step 364. If no, indicated at step 366, steps 330 to 352 are repeated. The antenna is then moved in elevation until maximum signal strength is achieved while maintaining the predetermined percentage difference between the carrier edges, step 368, FIG. 11C. Moving the antenna or reflector in the azimuth and elevation direction in steps 364 and 368 may include rough and fine steps, discussed below.

The result is an automated, modem-less method for tracking satellite transponder signals without the need for significant user intervention.

Figure 13:
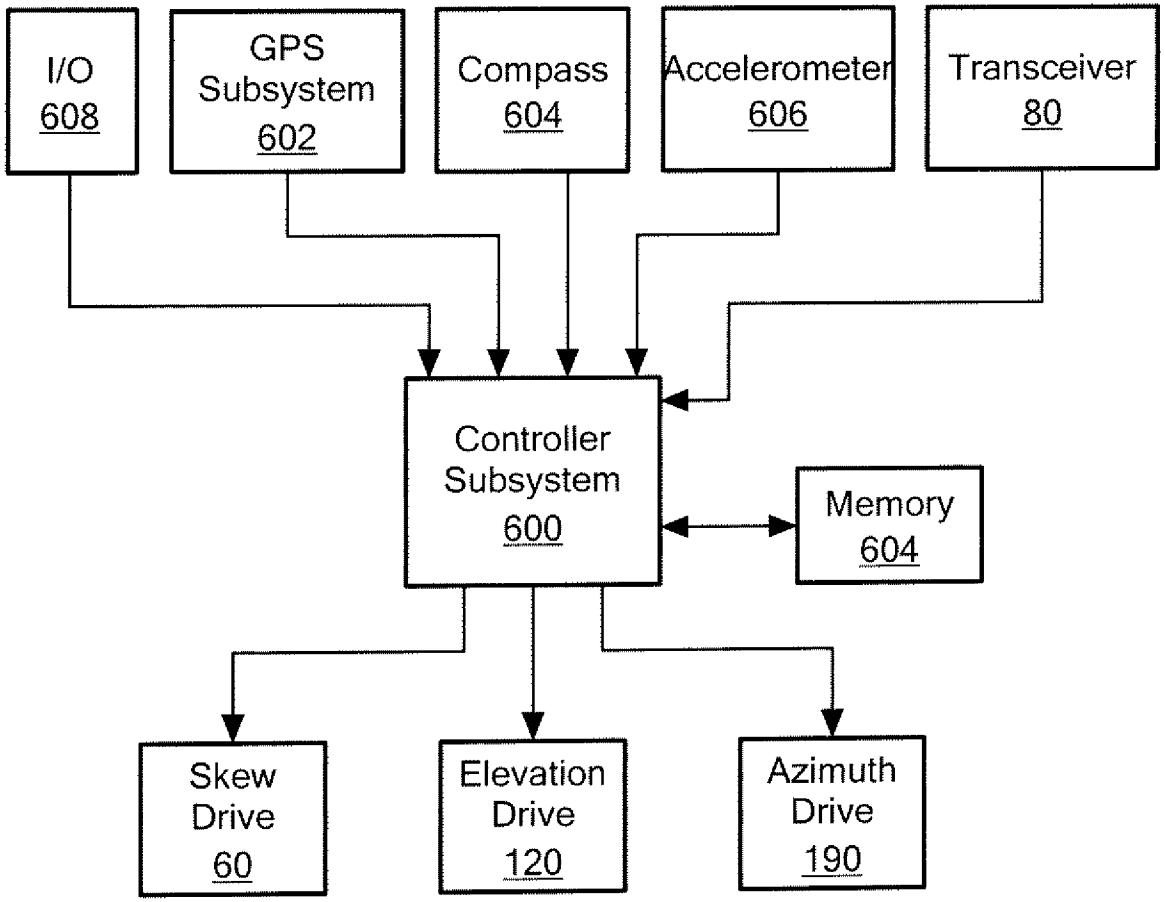
FIG. 13 is a block diagram showing the primary components associated with an example of an antenna system which automatically locks onto and tracks a satellite signal.

Ground reception of satellite broadcasts typically requires a number of data points to locate and lock onto an orbiting satellite. The following information is preferably provided to the automatic acquisition terminal controller subsystem 600, FIG. 13 in order for a terminal to acquire the specific signal from a specific satellite.

The GPS location of the satellite dish is provided via on-board GPS unit 602. The compass orientation of satellite dish is provided via compass unit 604. The physical orientation of dish placement (i.e., a level surface, an inclined surface) is provided using a three axis accelerometer 606. The Clarke Belt Position (Orbital Position) of the satellite is input using I/O section 608 or it can be retrieved from memory. The Transponder Center Frequency for the desired satellite can be entered, or is retrieved from memory. The Occupied Channel Bandwidth or Channel Symbol Rate of the satellite signal can be entered or retrieved from memory 604. The Antenna Beam Width is typically stored in memory based on the size of the dish.

In the first stage, the antenna is physically positioned on the ground or other surface. The automated, modem-less method for tracking satellite transponder signals of one or more embodiments of this invention is preferably part of an antenna positioning system which uses the stored Clarke Belt position of a satellite in conjunction with the compass and GPS data the terminal receives from its onboard software to determine the proper azimuth, elevation, and skew for the satellite in question.

Figure 14:
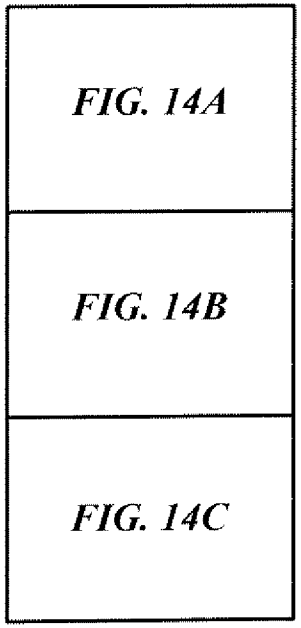
FIG. 14 is a block diagram depicting FIGS. 14A, 14B, and 14C.
Figure 14A:
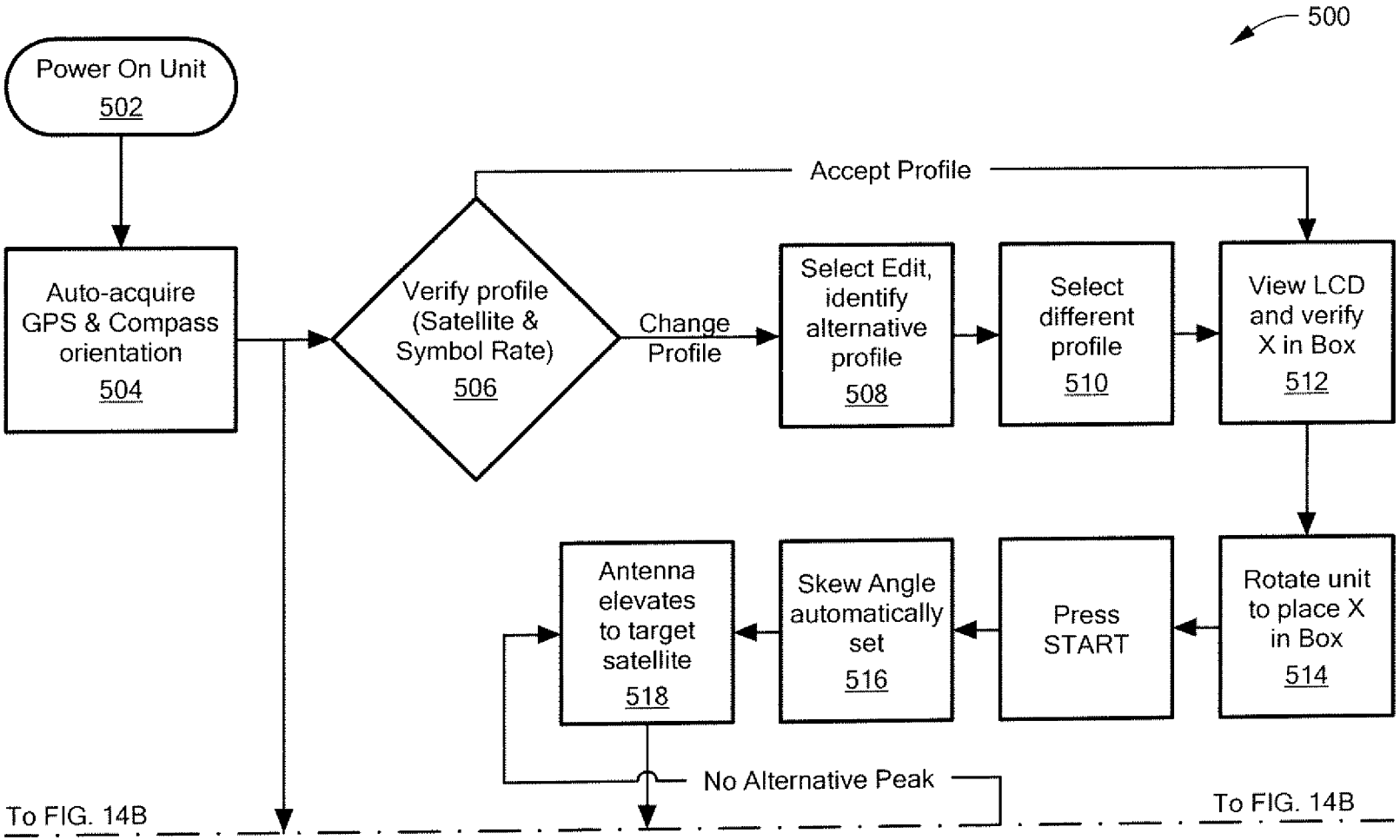
FIGS. 14A-14C are flow charts depicting the primary steps associated with the computer instructions of the controller subsystem shown in FIG. 13.

When powered ON, step 502, FIG. 14A, the base unit display 65, FIG. 3 displays a rough pointing icon in its onboard display. The display will show an 'X' and two brackets [ ], step 512, FIG. 14A. A User physically rotates the antenna unit until the X character shifts inside the bracket pair, called the "box", step 514. Once the X is inside the box, [X], the unit is set to the azimuth and ready to acquire a signal. We call this method for orienting satellite antennas "X in the Box" pointing. At step 504 in FIG. 14A, the controller knows where it is, knows where the satellite is, and knows how the unit must be moved to aim the dish at the satellite using data from GPS subsystem 602, compass 604, and accelerometer 606, FIG. 13. Other possible steps associated with the physical set up of the antenna include verifying the correct chosen satellite profile and symbol rate, step 506 and using menu drive commands to make edits, or select a different profile, steps 508 and 510.

Having the antenna oriented to the approximately correct location of the satellite allows the terminal to perform the necessary steps to maximize the broadcast signal reception. The receiving antenna needs to orient in such a manner so the reception of a given signal is optimized for maximum data reception. The acquisition and maximization of the signal is performed in multiple stages. First, the proper skew angle of the antenna dish is set to correspond to the main lobe of the broadcast signal from the satellite, step 516. Using the stored satellite and transponder data, the controller controls the skew drive 60, FIG. 13 to maximize signal reception.

Figure 14B:
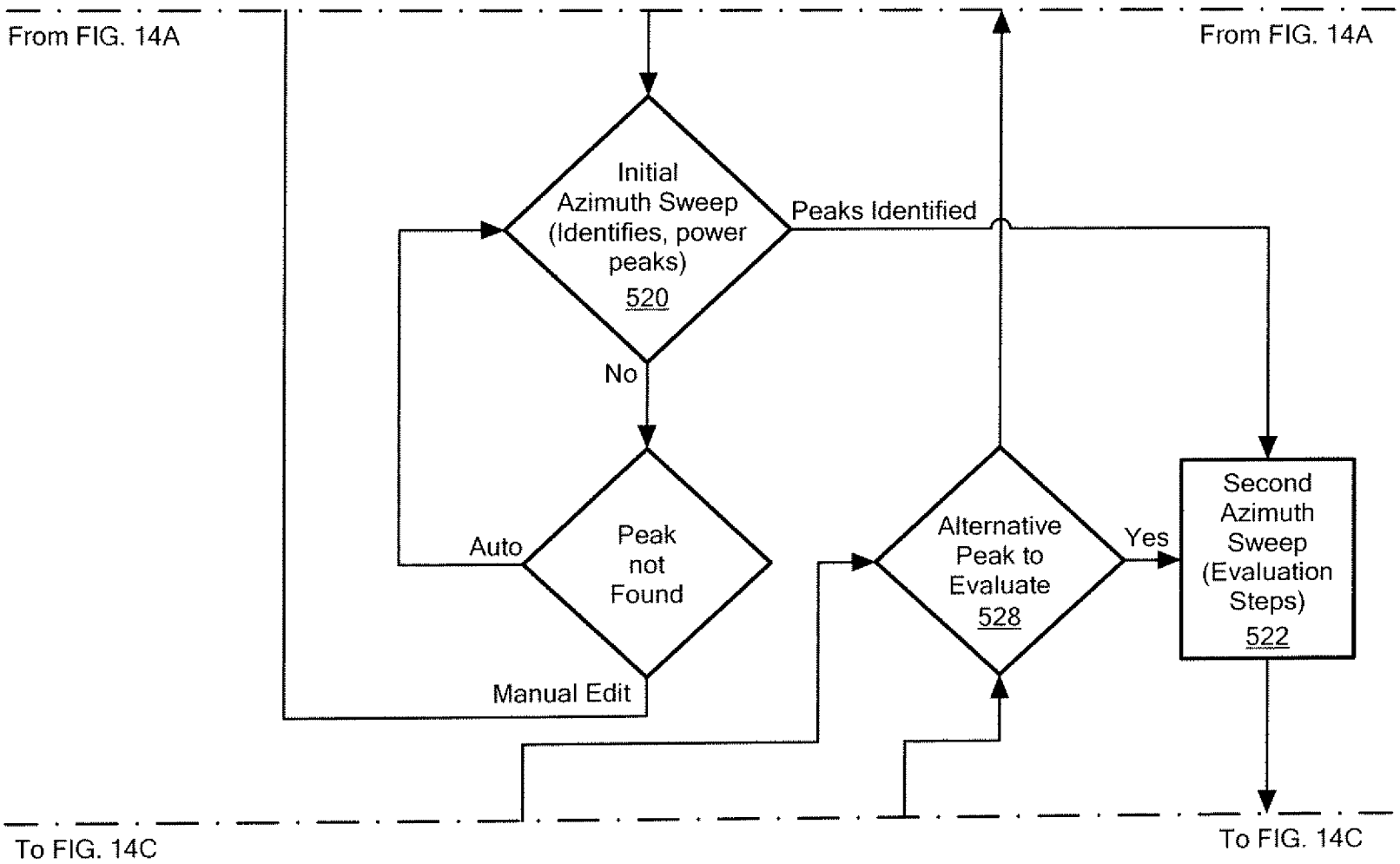

In the second stage, power peaks are identified. Using the stored Clarke Belt position of the satellite, GPS, and orientation of the satellite antenna, the controller calculates the signal to be located and then rotates the antenna dish to the correct elevation, step 518 by controlling elevation motor 120, FIG. 13. Once at the correct acquisition angle, the antenna performs an azimuth sweep at the set elevation, step 520, FIG. 14B by controlling the azimuth motor 190, FIG. 13.

The controller initially looks for RF power (from transceiver 80, FIG. 13) at the specified satellite transponder center frequency during its azimuth sweeps. If the signal is not found during the first sweep, additional sweeps are performed at incrementing and decrementing elevations step 522 until either the signal is found or the search times out.

When a power peak (438, FIG. 12) is detected at the specified transponder center frequency, the controller completes that azimuth sweep to determine if there are additional peaks at that elevation. Once the successful sweep is completed and peaks are found and stored, the controller drives the antenna back through the successful azimuth sweep to evaluate the power peaks.

In the third stage, the power peaks are evaluated. The power peak evaluation is preferably conducted in three steps. This evaluation process algorithm for automated, modem-less method for tracking satellite transponder signals may be embedded in firmware.

The first step in the power peak evaluation is to determine the Channel Bandwidth of a received peak signal at the particular center frequency. The Channel Bandwidth is determined by taking an RSSI (Received Signal Strength Indicator) reading at the center frequency of the signal, and then off-tuning receiver 80, FIG. 13 by about 40% of the Channel Symbol Rate and recording another reading. This off-tuned reading is compared to the initial reading and, if it is less than a 15% reduction in signal strength, the process is repeated. The controller will continue to off-tune the receiver from the center frequency in smaller steps until an approximate 15% reduction in signal strength is achieved. The frequency at the point the 15% reduction (e.g., 3 dB) is achieved is subtracted from the center frequency and multiplied by 2. In general, determining includes maximizing a function of the center frequency, the amplitude of the 3 dB right side of the signal, and the amplitude of the 3 dB left side of the signal. The resulting value is used as the Channel Bandwidth of the carrier in question, step 524, FIG. 14C.

For enablement purposes only, the following code portions are provided which can be executed on one or more microcontrollers, drivers, microprocessors, one or more processor, a computing device, or computer to carry out the primary steps and/or functions of systems and the methods thereof discussed above with reference to one or more FIGS. 1-14C and recited in the claims hereof. Other equivalent algorithms and code can be designed by a software engineer and/or programmer skilled in the art using the information provided herein.

```
//Function to find a given satellite
Start
  Determine edges of search window
  Move to horizontal edge
  Move to vertical center
  While( signal not found and vertical edge not reached )
    Move slowly to opposite horizontal edge
    While ( moving )
      Record signal strength and position
    End While
    Evaluate recorded data, looking for signals with the correct profile
    If ( potential signal found )
      Move to signal location
      Evaluate signal further, looking at channel bandwidth and
center frequency
```

-continued

```
      If ( proper signal verified )
        Return success and move on to peak signal
      End If
    End If
    Make another sweep attempt at a new vertical position
  End While
  //At this point the search has failed
  Return failure
End Function
```

Figure 14C:
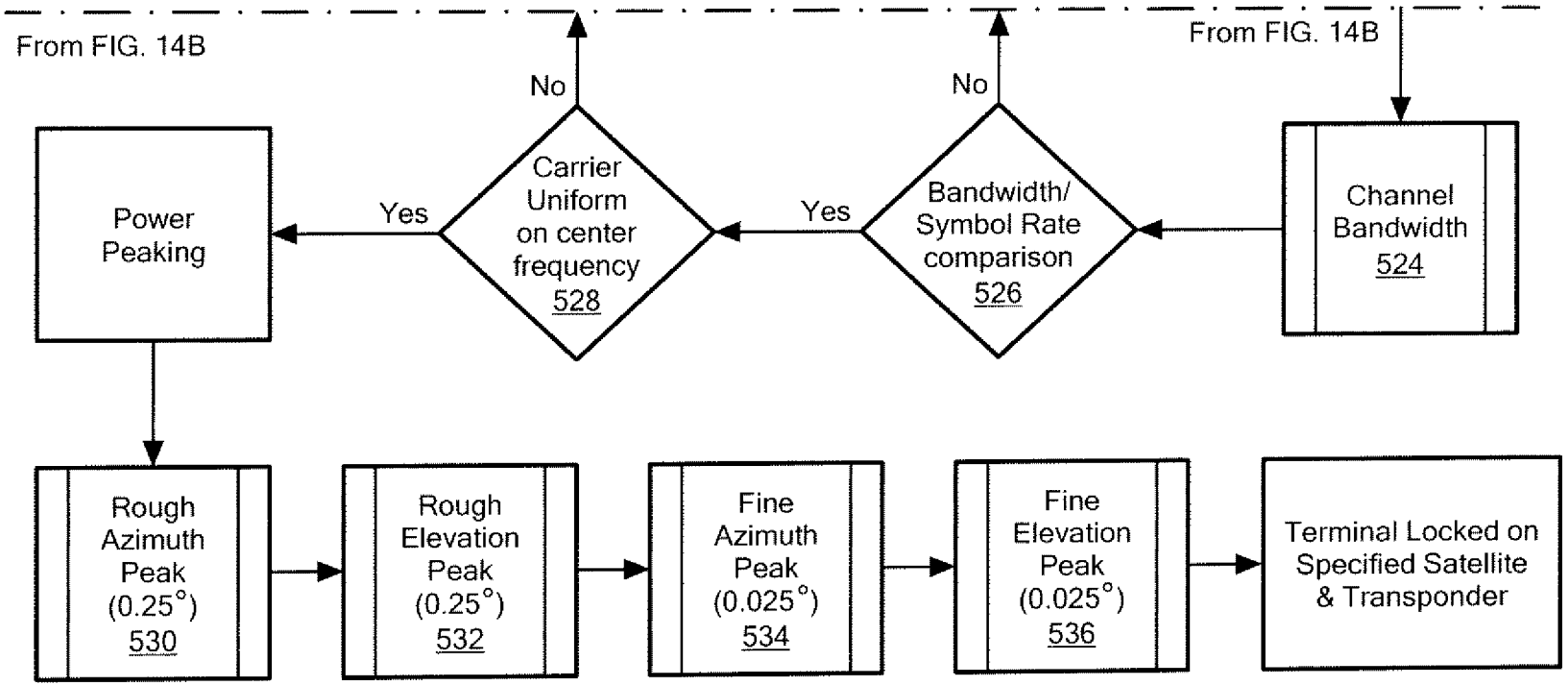

The second step in the power peak evaluation is to compare this calculated Channel Bandwidth of the carrier in question to the Channel Symbol Rate or Occupied Channel Bandwidth inputted to the terminal, step 526, FIG. 14C. If the Channel Bandwidth of the carrier in question is within a specified percentage of Channel Symbol Rate, the terminal moves to the last stage, course and fine tuning. If the signal does not meet this requirement, the power peak evaluation is aborted and the terminal moves the antenna to evaluate the next peak in the successful azimuth sweep, step 528. If no alternative peak was previously identified, the terminal resumes the azimuth search routine, step 520. The last step in the power peak evaluation stage is to verify that the signal in question is centered on the center channel. The controller tunes the receiver and takes readings at the center frequency and edges of the determined channel bandwidth. If the edges of the determined channel bandwidth of the signal in question are within a about 2% of each other, step 528, the terminal will begin the peaking process. If the signal is not centered, an alternative peak is evaluated, step 528. This process ensures that as between two signals with a similar bandwidth, the correct signal is chosen.

The signal strength maximizing stage is preferably conducted in four steps using the antenna beam width and the found channel bandwidth to maximize RSSI signal strength. The first step is a rough azimuth peak, step 530, FIG. 14C utilizing the found and stored channel bandwidth as a qualifier for each peaking step measurement as the azimuth of the antenna dish is varied. If the channel bandwidth edges are not within a specified percentage of each other, the peaking step is discarded. This allows the antenna to peak on only the carrier in question and prevents the antenna from peaking onto adjacent satellite signals. The controller will move the antenna dish in an azimuth sweep by increasingly smaller increments based on a percentage of the antenna beam width. The rough azimuth peak will maximize the signal to about 0.25 degrees of accuracy in azimuth.

The second step is a rough elevation peak, step 532 utilizing the found channel bandwidth as a qualifier for each peaking step measurement. If the channel bandwidth edges are not within a specified percentage of each other, the peaking step is discarded. This allows the terminal to peak on only the carrier in question and prevents the antenna from peaking onto adjacent satellite signals. The controller will move the antenna dish in an elevation sweep by increasingly smaller increments based on a percentage of the antenna beam width. The rough elevation peak will maximize the signal to about 0.25 degrees of accuracy in elevation.

The third step is a fine azimuth peak utilizing the found channel bandwidth as a qualifier for each peaking step measurement. If the channel bandwidth edges are not within a specified percentage of each other, the peaking step is discarded. This allows the antenna to peak on only the carrier in question and prevents the antenna from peaking onto adjacent satellite signals. The controller will move the antenna dish in an azimuth sweep by increasingly smaller increments, step 534 based on a percentage of the antenna beam width. The fine azimuth peak will maximize the signal to about 0.025 degrees of accuracy in azimuth.

The fourth step is a fine elevation peak sweep, step 536 utilizing the found channel bandwidth as a qualifier for each peaking step measurement. If the channel bandwidth edges are not within a specified percentage of each other, the peaking step is discarded. This allows the antenna to peak on only the carrier in question and prevents the antenna from peaking onto adjacent satellite signals. The controller will move the antenna in an elevation sweep by increasingly smaller increments based on a percentage of the antenna beam width. The fine elevation peak will maximize the signal to about 0.025 degrees of accuracy in elevation.

Once the azimuth and elevation are peaked at about the 0.025-degree of accuracy the antenna system has located and locked onto the specified transponder and signal from the specified satellite, step 540. This terminal then stores and uses this data to maintain automatic signal lock during the communication time between the satellite antenna system and the satellite. In the event that the signal is lost due to environmental or other conditions, the controller will use the prior, stored data and peaking steps to re-acquire the signal from the satellite transponder. In a maintenance mode, every time period X (e.g., ½ hour), power peaking and/or other stages described above can be performed to lock into a signal in case the satellite gets bumped or otherwise moves. For satellite antenna systems without an automated skew adjustment, the skew angle adjustment steps described above are not employed.

Although specific features of the invention are shown in some drawings and not in others, this is for convenience only as each feature may be combined with any or all of the other features in accordance with the invention. The words "including", "comprising", "having", and "with" as used herein are to be interpreted broadly and comprehensively and are not limited to any physical interconnection. Moreover, any embodiments disclosed in the subject application are not to be taken as the only possible embodiments.

In addition, any amendment presented during the prosecution of the patent application for this patent is not a disclaimer of any claim element presented in the application as filed: those skilled in the art cannot reasonably be expected to draft a claim that would literally encompass all possible equivalents, many equivalents will be unforeseeable at the time of the amendment and are beyond a fair interpretation of what is to be surrendered (if anything), the rationale underlying the amendment may bear no more than a tangential relation to many equivalents, and/or there are many other reasons the applicant cannot be expected to describe certain insubstantial substitutes for any claim element amended.

Other embodiments will occur to those skilled in the art and are within the following claims.

What is claimed is:

1. A portable antenna system comprising:

a reflector with a center axis;

a feed at the center axis of the reflector;

a post with a rotatable bracket on the post;

a skew drive mounted to the bracket and having a first output coupled to the reflector at the center axis thereof to adjust the skew angle of the reflector and a second output coupled to a transceiver to adjust the skew angle of the transceiver;

an elevation motor configured to rotate the rotatable bracket to vary the elevation of the reflector; and an azimuth motor configured to rotate the post to vary the azimuth of the reflector.

2. The antenna system of claim 1 wherein the skew drive is configured to rotate the first output at the same rate as the second output.

3. The antenna system of claim 1 wherein the post further comprises a distal housing and wherein the rotatable bracket is rotatably attached to said distal housing.

4. The antenna system of claim 3 wherein the elevation motor is fixed inside the housing and comprises an output drive coupled to the rotatable bracket.

5. The antenna system of claim 1 further comprising a base unit supporting the post.

6. The antenna system of claim 5 wherein the base unit comprises an azimuth motor configured to rotate the post with respect to the base unit.

7. The antenna system of claim 5 wherein the base unit comprises a computer subsystem configured to control the skew drive, the elevation motor, and the azimuth motor.

8. The antenna system of claim 5 further comprising a tripod supporting the base unit.

9. The antenna system of claim 1 wherein the reflector comprises a plurality of petals releasably coupled together.

10. The antenna system of claim 1 wherein the rotation of the first and second output causes the reflector and transceiver to rotate at the same rate.

11. A portable antenna system comprising:

a first flange with a center axis configured to connect to a reflector antenna;

a second flange with a center axis configured to connect to a transceiver;

a feed at the center axis of the first flange;

a post with a rotatable bracket on the post;

a skew drive mounted to the bracket and having a first output coupled to the first flange at the center axis thereof to adjust the skew angle of the first flange when connected to the reflector antenna and having a second output coupled to the second flange at the center axis thereof to adjust the skew angle of the second flange when connected to the transceiver;

an elevation motor configured to rotate the rotatable bracket to vary the elevation of the first flange when connected to a reflector antenna; and an azimuth motor configured to rotate the post to vary the azimuth of first flange when connected to a reflector antenna.

12. The antenna system of claim 11 wherein the skew drive is configured to rotate the first output at the same rate as the second output.

13. The antenna system of claim 11 wherein the post further comprises a distal housing and wherein the rotatable bracket is rotatably attached to said distal housing.

14. The antenna system of claim 13 wherein the elevation motor is fixed inside the housing and comprises an output drive coupled to the rotatable bracket.

15. The antenna system of claim 11 further comprising a base unit supporting the post, wherein the base unit comprises an azimuth motor configured to rotate the post with respect to the base unit and a computer subsystem configured to control the skew drive, the elevation motor, and the azimuth motor.

16. The antenna system of claim 11 wherein the reflector comprises a plurality of petals releasably coupled together.

* * * * *